US008162247B2

(12) United States Patent
Faulker

(10) Patent No.: US 8,162,247 B2
(45) Date of Patent: Apr. 24, 2012

(54) GRINDING SYSTEM

(75) Inventor: Michael Faulker, Leominster, MA (US)

(73) Assignee: Biomedical Polymers, Inc., Gardner, MA (US)

( * ) Notice: Subject to any disclaimer, the term of this patent is extended or adjusted under 35 U.S.C. 154(b) by 119 days.

(21) Appl. No.: 12/806,583

(22) Filed: Aug. 17, 2010

(65) Prior Publication Data

US 2012/0043405 A1 Feb. 23, 2012

(51) Int. Cl.
*B02C 19/00* (2006.01)

(52) U.S. Cl. ..... 241/169.2; 241/2

(58) Field of Classification Search ..... 241/2, 168, 241/169, 169.1, 169.2
See application file for complete search history.

(56) References Cited

U.S. PATENT DOCUMENTS 4,715,545 A 12/1987 Hanifl et al.
5,533,683 A 7/1996 Fay et al.
5,829,696 A 11/1998 DeStefano et al.

*Primary Examiner* — Mark Rosenbaum
(74) *Attorney, Agent, or Firm* — Iandiorio Teska & Coleman, LLP

(57) ABSTRACT

A grinding system includes a mortar container having an open top portion and a bottom portion having a first interior grinding surface and a wall portion interconnecting the top and bottom portions for defining a hollow interior collection chamber, a modular pestle assembly including a universal pestle shaft having at its proximate end an actuator portion extending above the top portion and at its distal end a mounting portion for receiving one of a set of pairs of matching tips and pestle collars, the pestle tip having a second grinding surface for engaging the first grinding surface, and a closure device sealingly engageable with the pestle assembly and the open top portion for sealing the container and the collection chamber between the grinding surfaces and the top portion of the mortar container.

24 Claims, 4 Drawing Sheets

GRINDING SYSTEM

FIELD OF THE INVENTION

This invention relates to a grinding system and more particularly to such a system with a modular pestle assembly for receiving a number of different pestle tips and collars with use in multiple tube configurations for a variety of applications, i.e. research, clinical, industrial.

BACKGROUND OF THE INVENTION

Grinders are widely used to grind up small quantities of material for further processing and analysis. A container acting as a mortar has a grinding surface in the interior of its base usually conical or rounded in shape for receiving the grinding material. A pestle which is received in the container has a similarly shaped grinding surface and a cap is sealing engaged with the pestle shaft and the top of the container. Often the pestle is made in two or more parts which requires an assembly step and more importantly introduces the opportunity for misalignment of the pestle shaft during assembly. This can result in misalignment of the grinding surfaces and poor grinding results. Another issue is the complexity of the sealing of the cap with the container. Typically the cap requires an intricate sealing structure at its periphery for sealingly engaging the container and another device at its center for sealingly engaging the pestle shaft. A further issue arises because a number of different sizes are needed. Offering grinders of a number of different sizes require not only a number of different size containers but a number of different pestles with a number of different matching sizes of grinding tips. Another problem encountered when the pestle tip is made of one solid piece is "sinking". Sinking is the dimpling or concavity which occurs in thick molded parts where cooling causes shrinkage resulting in surface sinking. This is critical when it occurs in the grinding surface area of the tip. Presently attempts to prevent sinking require extra manufacturing steps including a water bath.

BRIEF SUMMARY OF THE INVENTION

It is therefore an object of this invention to provide an improved grinding system.

It is a further object of this invention to provide such an improved grinding system with improved grinding performance.

It is a further object of this invention to provide such an improved grinding system with improved grinding performance in multiple configurations.

It is a further object of this invention to provide such an improved grinding system in which the pestle is straight, properly aligned with its grinding surface and with the grinding surface in the container.

It is a further object of this invention to provide such an improved grinding system which has an effective, less complex sealing arrangement between the cap and container and between the cap and pestle.

It is a further object of this invention to provide such an improved grinding system which is simpler, less expensive, easier to manufacture and capable of providing different sizes of pestle grinding tips but using a universal or common pestle shaft.

It is a further object of this invention to provide such an improved grinding system which is modular and can provide a number of different pestle grinding tips using the same pestle shaft.

It is a further object of this invention to provide such an improved grinding system in which the tip and collar can be made hollow to prevent sinking and reduce the cost of materials.

The invention results from the realization that an improved, modular grinding system which is simpler, easier and less expensive can be achieved using a modular pestle assembly including a universal pestle shaft having at its proximate end an actuator portion extending above the top portion of the container and at its distal end a mounting portion for receiving sets of pairs of matching pestle tips and pestle collars. A closure device sealingly engages with the pestle assembly and the top of the container to define a collection chamber.

The subject invention, however, in other embodiments, need not achieve all these objectives and the claims hereof should not be limited to structures or methods capable of achieving these objectives.

This invention features a grinding system including a mortar container having an open top portion and a bottom portion having a first interior grinding surface and a wall portion interconnecting the top and bottom portions for defining a hollow interior collection chamber. A modular pestle assembly includes a universal pestle shaft having at its proximate end an actuator portion extending above the top portion and at its distal end a mounting portion for receiving one of a set of pairs of matching tips and pestle collars, the pestle tip having a second grinding surface for engaging the first grinding surface. A closure device sealingly engageable with the pestle assembly and the open top portion seals the container and the collection chamber between the grinding surfaces and the top portion of the mortar container.

In a preferred embodiment the material ground may be tissue; each pestle collar may include a mounting hole for engaging the pestle shaft and the mounting portion may include a collar stop element for defining the position of the collar on the pestle shaft. Each pestle tip may include a drive hole and the distal end of the pestle shaft may include a drive stub for engaging the drive hole for rotating the pestle tip and the second grinding surface relative to the first grinding surface. The pestle tip may be substantially solid except for the drive hole. The pestle tip may be substantially hollow except for a hub containing the drive hole. Each collar may have an edge engaging a congruent edge of the associated pestle tip. Each pestle collar and tip may be joined at the edges. The pestle collar may have an inclined wall extending from the mounting hole to the edge of the collar for shedding grinding medium downwardly toward the grinding surfaces. The closure may include a cap engaged with the open top portion of the container and the cap may include a resilient sealing member for sealing between the cap and the top portion of the container and between the cap and the pestle assembly. The pestle shaft may include an upper cap stop element for limiting movement of the pestle shaft into the container. The pestle shaft may include a lower cap stop element for limiting movement of the pestle shaft out of the container.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
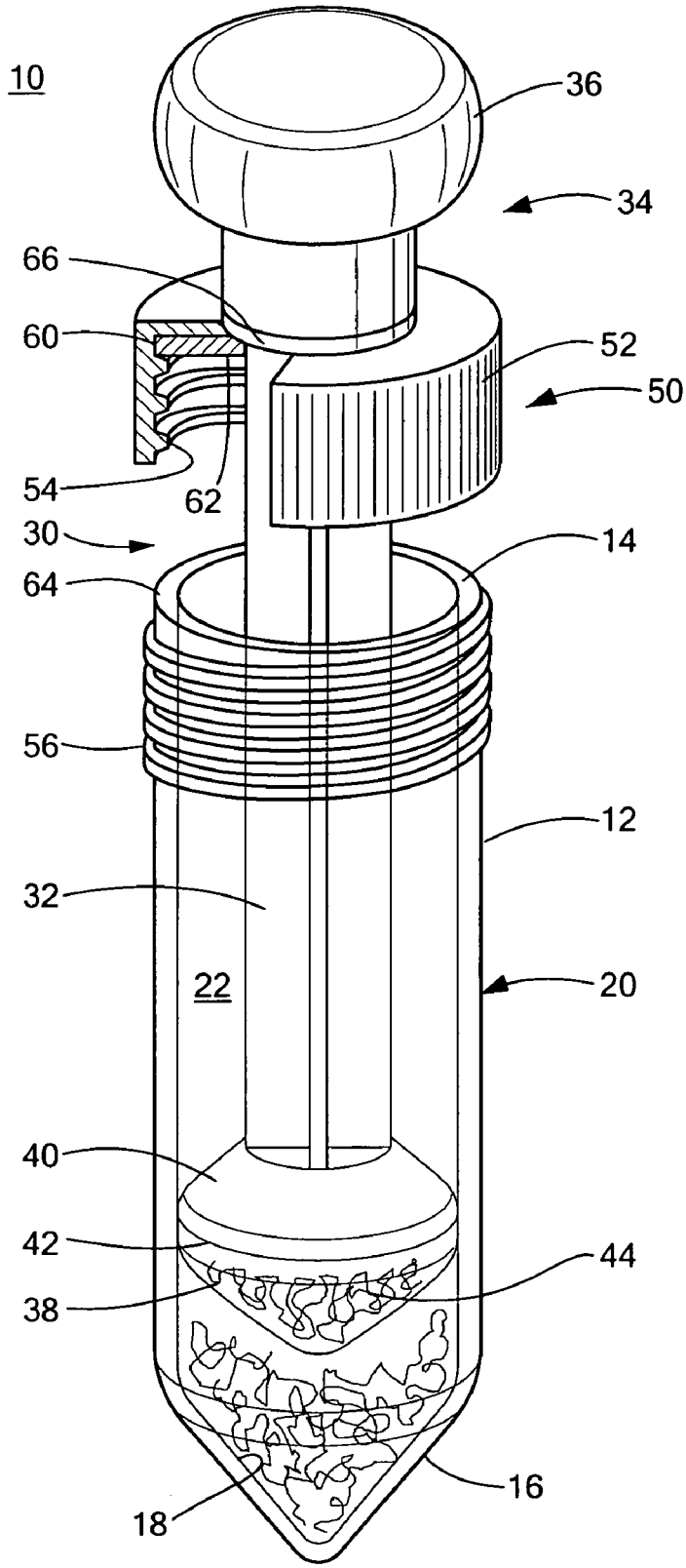
FIG. 1 is a three dimensional schematic diagram of a grinding system used for grinding tissue according to one embodiment.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

The grinding system of this invention may be used in a number of different applications such as plant research, mineral research, pharmaceutical research, (e.g. tablets), wood pulp, animal research and with human tissue, bone and cartilage. One of the more likely uses is for tissue grinding and the embodiment described here will be directed to that.

There is shown in FIG. 1 a tissue grinding system 10 including a mortar container 12 having an open top portion 14 and a bottom portion 16 having a first grinding surface 18 on its interior. A wall 20 interconnects top portion 14 and bottom portion 16 forming a tubular collection chamber 22. There is a modular pestle assembly 30 including a universal pestle shaft 32 having at its proximal end 34 an actuator portion 36 extending above the top portion 14 of container 12 and at its distal end a mounting portion, not visible in FIG. 1, which mounts any one of a set of pairs of matching pestle tip 38 and pestle collar 40 which are joined together at joining line 42, such as by ultrasonic welding, heating or an adhesive. Collar 40 includes a sloped surface 41 which permits any overflow tissue or fluid in chamber 22 to slide downwardly and back into the grinding area between grinding surfaces 44 and 18. Pestle tip 38 contains a second grinding surface 44 which mates with and cooperates with grinding surface 18. A closure device 50 includes a cap 52 which contains internal threads 54 that engage with threads 56 on the outside of mortar container 12. A sealing medium, layer 60, extends across the top of cap 52 so that at its outer edge 62 it sealing engages with the top edge 64 of mortar container 12. At its inner edge 63, FIG. 2, it engages with a portion of the pestle assembly 30 and sealingly engages it, thereby effectively sealing chamber 22 in container 12. Layer 60 may be made of approximately 40 thousands of an inch thick material such as F217 foam. Pestle assembly 30 also includes an upper cap stop 66, FIG. 1, which limits the motion of the pestle assembly into container 12.

Figure 2:
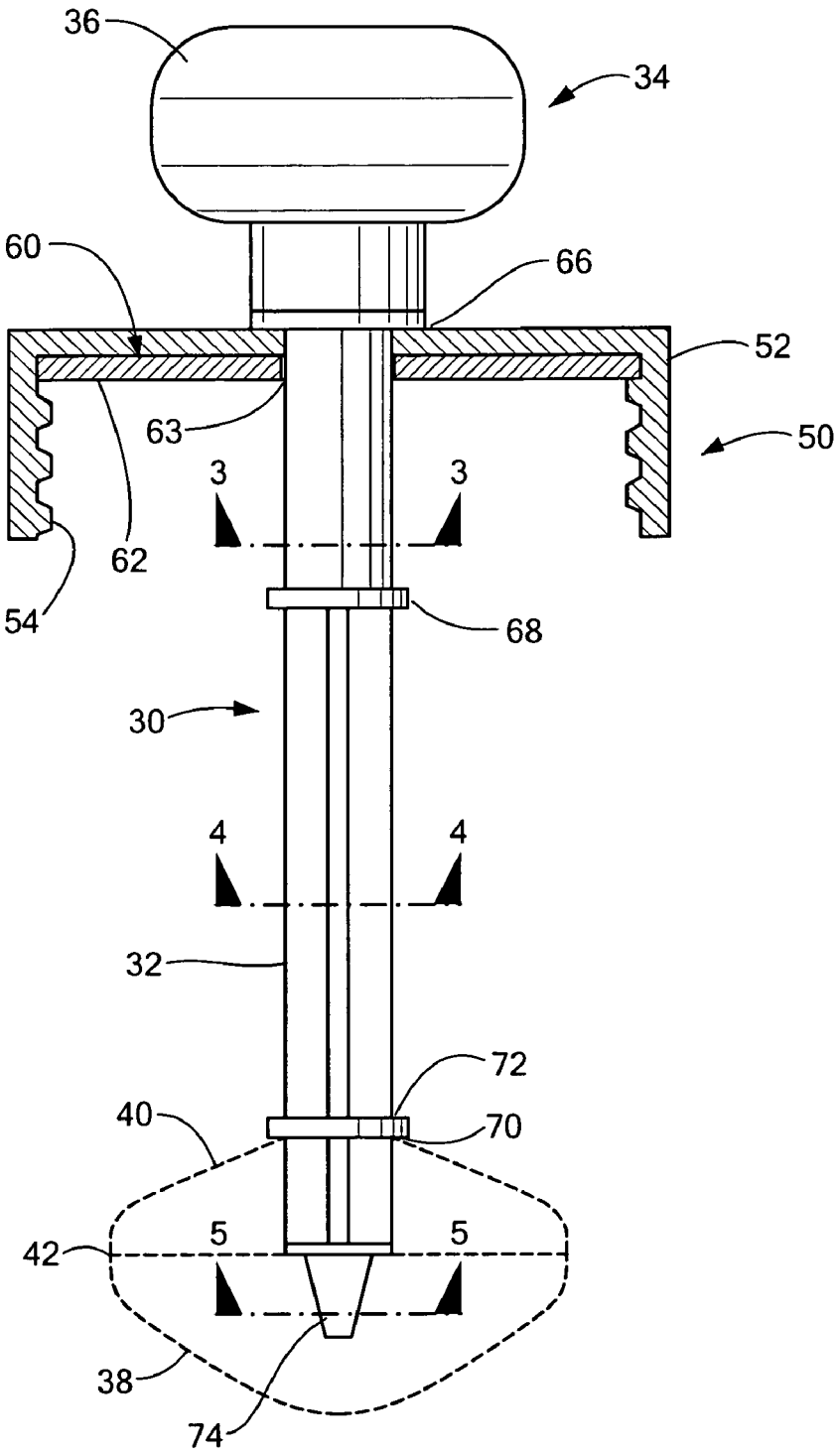
FIG. 2 is a side, elevational cross-section view of the pestle and cap of FIG. 1.
Figure 3:
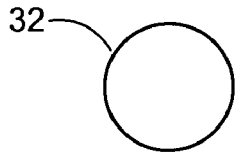
FIGS. 3, 4 and 5 are cross-sectional views along lines 3-3, 4-4, and 5-5, respectively, of FIG. 2.
Figure 4:
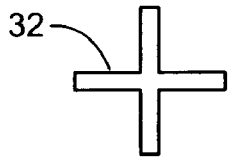
Figure 5:
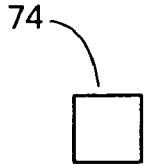

A second lower cap stop 68, FIG. 2, limits the upward or extracting motion of pestle shaft 32 with respect to cap 52. Collar 40 includes a hole 70 which engages with collar stop 72 on pestle shaft 32 which serves to properly position collar 40. Tip 38 includes a hole which receives pyramid shaped drive stub 74 on the distal end of shaft 32. The entire shaft 32 is a single integral element including cap stops 66 and 68 and actuator 36. In the area between cap stops 66 and 68, shaft 32 has a circular cross section as shown in FIG. 3. As shown in FIG. 4, between cap stop 68 and collar stop 72, shaft 32 has a cross or X shape. The pyramidical shape of drive stub 74 is confirmed by the square cross section of stub 74 shown in FIG. 5.

Figure 6:
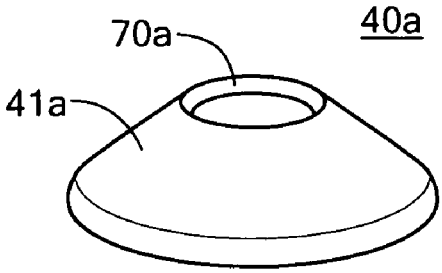
FIG. 6 is a three dimensional view of a collar according to one embodiment.
Figure 7:
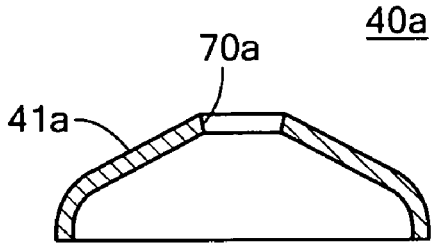
FIG. 7 is a cross-sectional view of the hollow collar of FIG. 6.
Figure 8:
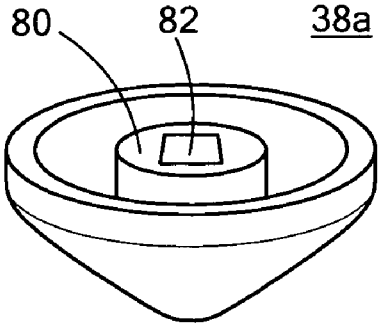
FIG. 8 is a three dimensional view of a hollow tip according to one embodiment; usable with the collar of FIG. 6.
Figure 9:
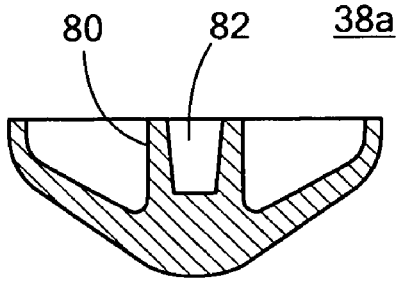
FIG. 9 is a cross-sectional view of the hollow tip of FIG. 8.
Figure 10:
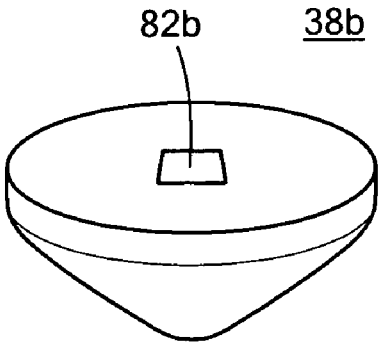
FIG. 10 is a three dimensional view of the solid tip similar to that of FIG. 8.
Figure 11:
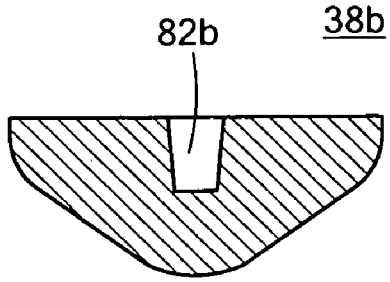
FIG. 11 is a cross-sectional view of the solid tip of FIG. 10.
Figure 12:
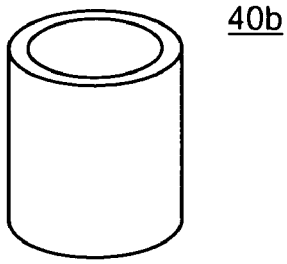
FIG. 12 is a three dimensional view of another collar according to one embodiment.
Figure 13:
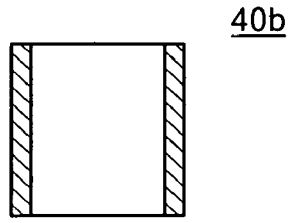
FIG. 13 is a cross-sectional view of the collar of FIG. 12.
Figure 14:
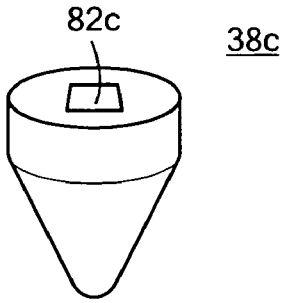
FIG. 14 is a three dimensional view of a tip according to one embodiment usable with the collar of FIG. 12.
Figure 15:
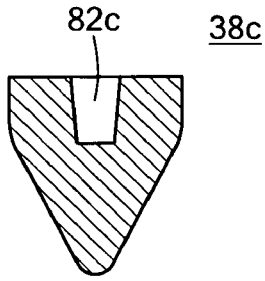
FIG. 15 is a cross-sectional view of the tip of FIG. 14.
Figure 16:
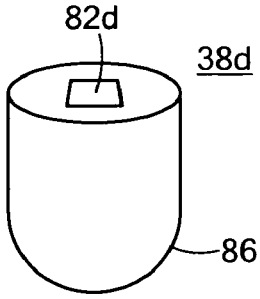
FIG. 16 is another shape and size of tip according to one embodiment usable with the collar of FIG. 12.
Figure 17:
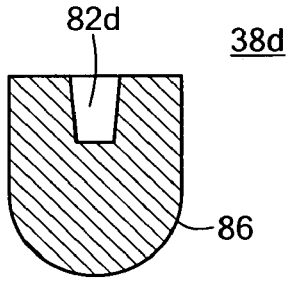
FIG. 17 is a cross-sectional view of the tip of FIG. 16.
Figure 18:
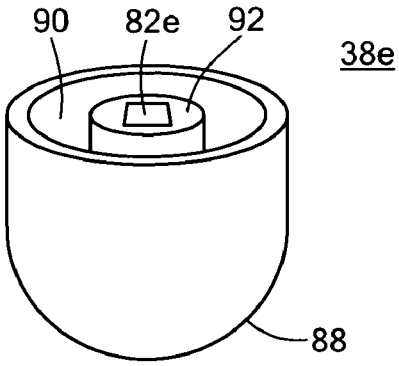
FIG. 18 is another shape and size of tip according to one embodiment useable with the collar of FIG. 6.
Figure 19:
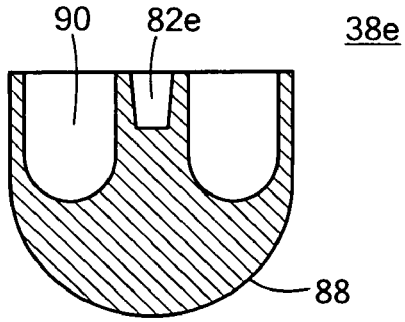
FIG. 19 is a cross-sectional view of the tip of FIG. 18.

The universality of pestle assembly 30 and its use in a modular system can be better understood with reference to FIGS. 6-19 which show a variety of tips and collars of different shapes and sizes all of which can be mounted on the same universal pestle assembly 30 and shaft 32. Collar 40*a*, FIGS. 6 and 7, is hollow and includes a hole 70*a* and inclined surface 41*a*. A mating tip 38*a* is shown in FIGS. 8 and 9. It is hollow but has a central hub 80 which contains a drive hole 82 which matches the shape, in this case, pyramidical of the drive stub 74, FIG. 2. The hollow nature of collar 48*a* and tip 38*a* and other hollow collars and tips enables the castings to be made simply without the danger of sinking occurring in critical areas. If desired a solid tip 38*b*, FIGS. 10 and 11 can be constructed containing only drive hole 82*b*. A smaller, hollow, cylindrical collar 40*b*, FIGS. 12 and 13 may be used in conjunction with a tip such as tip 38*c*, FIGS. 14 and 15 which may be solid having a simple drive hole 82*c*. There is no particular shape dictated by this invention for the tips or the collars, for example tip 38*d*, FIGS. 16 and 17 may have a rounded or even parabolic shape as at 86. A larger and hollow tip 38*e*, FIGS. 18 and 19 may be constructed also with a rounded or parabolic surface 88 and it may be hollow as at 90 using a hub 92 to present drive hole 82*e*. Similarly, the size and shape of container 12 may vary with applications and is limited to no particular size or shape except as dictated by function and the need for the engagement of the grinding surface. For example, 15 ml and 50 ml containers are commonly used.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A tissue grinding system comprising:

a mortar container having an open top portion and a bottom portion having a first interior grinding surface and a wall portion interconnecting said top and bottom portions for defining a hollow interior collection chamber;

a modular pestle assembly including a universal pestle shaft having at its proximate end an actuator portion extending above said top portion and at its distal end a mounting portion for receiving one of a set of pairs of matching tips and pestle collars, said pestle shaft extending through said pestle collar, said pestle tip having a second grinding surface for engaging said first grinding surface; and a closure device sealingly engageable with said pestle assembly and said open top portion for sealing said container and the collection chamber between said grinding surfaces and said top portion of said mortar container.

2. The tissue grinding system of claim 1 in which each said pestle collar includes a mounting hole for engaging said pestle shaft and said mounting portion includes a collar stop element for defining the position of said collar on said pestle shaft.

3. The tissue grinding system of claim 1 in which each said pestle tip includes a drive hole and the distal end of said pestle shaft includes a drive stub for engaging said drive hole for rotating said pestle tip and said second grinding surface relative to said first grinding surface.

4. The tissue grinding system of claim 3 in which said pestle tip is substantially solid except for said drive hole.

5. The tissue grinding system of claim 3 in which said pestle tip is substantially hollow except for a hub containing said drive hole.

6. The tissue grinding system of claim 1 in which each said collar has an edge engaging a congruent edge of the associated pestle tip.

7. The tissue grinding system of claim 6 in which each said pestle collar and tip are joined at said edges.

8. The tissue grinding system of claim 7 in which said pestle collar has an inclined wall extending from said mounting hole to said edge of said collar for shedding grinding medium downwardly toward said grinding surfaces.

9. The tissue grinding system of claim 1 in which said closure includes a cap engaged with said open top portion of said container and said cap includes a resilient sealing member for sealing between said cap and said top portion of said container and between said cap and said pestle assembly.

10. The tissue grinding system of claim 9 in which said pestle shaft includes an upper cap stop element for limiting movement of said pestle shaft into said container.

11. The tissue grinding system of claim 1 in which said pestle shaft includes a lower cap stop element for limiting movement of said pestle shaft out of said container.

12. A grinding system comprising:

a mortar container having an open top portion and a bottom portion having a first interior grinding surface and a wall portion interconnecting said top and bottom portions for defining a hollow interior collection chamber;

a modular pestle assembly including a universal pestle shaft having at its proximate end an actuator portion extending above said top portion and at its distal end a mounting portion for receiving one of a set of pairs of matching tips and pestle collars, said pestle shaft extending through said pestle collar, said pestle tip having a second grinding surface for engaging said first grinding surface; and a closure device sealingly engageable with said pestle assembly and said open top portion for sealing said container and the collection chamber between said grinding surfaces and said top portion of said mortar container.

13. The grinding system of claim 12 in which each said pestle collar includes a mounting hole for engaging said pestle shaft and said mounting portion includes a collar stop element for defining the position of said collar on said pestle shaft.

14. The grinding system of claim 12 in which each said pestle tip includes a drive hole and the distal end of said pestle shaft includes a drive stub for engaging said drive hole for rotating said pestle tip and said second grinding surface relative to said first grinding surface.

15. The grinding system of claim 14 in which said pestle tip is substantially solid except for said drive hole.

16. The grinding system of claim 14 in which said pestle tip is substantially hollow except for a hub containing said drive hole.

17. The grinding system of claim 12 in which each said collar has an edge engaging a congruent edge of the associated pestle tip.

18. The grinding system of claim 17 in which each said pestle collar and tip are joined at said edges.

19. The grinding system of claim 18 in which said pestle collar has an inclined wall extending from said mounting hole to said edge of said collar for shedding grinding medium downwardly toward said grinding surfaces.

20. The grinding system of claim 12 in which said closure includes a cap engaged with said open top portion of said container and said cap includes a resilient sealing member for sealing between said cap and said top portion of said container and between said cap and said pestle assembly.

21. The grinding system of claim 20 in which said pestle shaft includes an upper cap stop element for limiting movement of said pestle shaft into said container.

22. The grinding system of claim 12 in which said pestle shaft includes a lower cap stop element for limiting movement of said pestle shaft out of said container.

23. A grinding system comprising:

a mortar container having an open top portion and a bottom portion having a first interior grinding surface and a wall portion interconnecting said top and bottom portions for defining a hollow interior collection chamber;

a modular pestle assembly including a universal pestle shaft having at its proximate end an actuator portion extending above said top portion and at its distal end a mounting portion for receiving one of a set of pairs of matching tips and pestle collars, each said collar having an edge engaging and joining a congruent edge of an associated pestle tip, said pestle tip having a second grinding surface for engaging said first grinding surface; and a closure device sealingly engageable with said pestle assembly and said open top portion for sealing said container and the collection chamber between said grinding surfaces and said top portion of said mortar container.

24. A grinding system comprising:

a mortar container having an open top portion and a bottom portion having a first interior grinding surface and a wall portion interconnecting said top and bottom portions for defining a hollow interior collection chamber;

a modular pestle assembly including a universal pestle shaft having at its proximate end an actuator portion extending above said top portion and at its distal end a mounting portion for receiving one of a set of pairs of matching tips and pestle collars, said pestle collar including a mounting hole and an inclined wall extending from said mounting hole to an edge of said collar for shedding grinding medium downwardly, said pestle tip having a second grinding surface for engaging said first grinding surface; and a closure device sealingly engageable with said pestle assembly and said open top portion for sealing said container and the collection chamber between said grinding surfaces and said top portion of said mortar container.

* * * * *